US007661244B2

(12) United States Patent
Downhill

(10) Patent No.: US 7,661,244 B2
(45) Date of Patent: Feb. 16, 2010

(54) PACKAGING APPARATUS FOR HELICALLY WRAPPING ARTICLES

(75) Inventor: Graham Paul Downhill, Lancashire (GB)

(73) Assignee: Oakbridge Investments Limited (GB)

( * ) Notice: Subject to any disclaimer, the term of this patent is extended or adjusted under 35 U.S.C. 154(b) by 161 days.

(21) Appl. No.: 11/719,073

(22) PCT Filed: Nov. 9, 2005

(86) PCT No.: PCT/GB2005/004307

§ 371 (c)(1),
(2), (4) Date: May 10, 2007

(87) PCT Pub. No.: WO2006/051281

PCT Pub. Date: May 18, 2006

(65) Prior Publication Data

US 2008/0184676 A1 Aug. 7, 2008

(30) Foreign Application Priority Data

Nov. 10, 2004 (GB) ..... 0424754.0

(51) Int. Cl.
*B65B 11/58* (2006.01)
*B65B 53/00* (2006.01)

(52) U.S. Cl. ..... 53/176; 53/556; 53/588; 53/210

(58) Field of Classification Search ..... 53/399, 53/441, 449, 465, 588, 556, 170, 176, 210; *B65B 11/58*
See application file for complete search history.

(56) References Cited

U.S. PATENT DOCUMENTS 1,215,930 A * 2/1917 Hadert ..... 53/210
4,302,920 A 12/1981 Lancaster et al.
4,317,322 A * 3/1982 Lancaster et al. ..... 53/399
4,524,568 A * 6/1985 Lancaster et al. ..... 53/556
4,712,354 A * 12/1987 Lancaster et al. ..... 53/176

(Continued)

FOREIGN PATENT DOCUMENTS

EP 0936141 8/1999

OTHER PUBLICATIONS

International Search Report from the European Patent Office, for PCT application PCT/GB2005/0041307, 3 pages, dated Feb. 2006.

*Primary Examiner*—Stephen F Gerrity
(74) *Attorney, Agent, or Firm*—Michael Best & Friedrich LLP

(57) ABSTRACT

Packaging apparatus for helically wrapping articles with a stretchable flexible film of wrapping material. A first conveyor (11) transports unwrapped articles towards a wrapping material applicator (13) and a second conveyor (12) transports helically wrapped articles. The first and second conveyors are spaced apart and the wrapping material applicator (13) is disposed between the first and second conveyors. The wrapping material is applied between the first and second conveyors to wrap an article disposed in space between the conveyors. The applicator has a rotary ring (14) supported in rotation by a fixed guide ring. Wrapping film reels are mounted on the rotary ring and unwound around tensioning rollers. Relative motion of the guide and rotary rings is converted into rotation of the tensioning rollers by a gear train so the wrapping material is stretched prior to application to the articles. The packaging apparatus may be used to wrap any material around any sort of article.

29 Claims, 12 Drawing Sheets

U.S. PATENT DOCUMENTS 4,730,436 A * 3/1988 Angelino ..... 53/170
5,012,631 A * 5/1991 Hostetler et al. ..... 53/588
5,016,427 A * 5/1991 Thimon et al. ..... 53/441
5,027,579 A 7/1991 Keip
5,027,581 A * 7/1991 Kovacs ..... 53/399
5,182,894 A * 2/1993 Bate ..... 53/399
5,285,891 A * 2/1994 Keip ..... 53/588
5,311,725 A * 5/1994 Martin et al. ..... 53/556
5,423,161 A * 6/1995 Huson et al. ..... 53/449
5,433,058 A 7/1995 Peterson
5,531,061 A * 7/1996 Peterson ..... 53/588
5,799,471 A * 9/1998 Chen ..... 53/556
6,006,498 A 12/1999 Cleine
6,192,653 B1 * 2/2001 Maekawa et al. ..... 53/588
6,745,544 B2 * 6/2004 Matsumoto et al. ..... 53/399

* cited by examiner

PACKAGING APPARATUS FOR HELICALLY WRAPPING ARTICLES

BACKGROUND OF THE INVENTION

The present invention relates to a method and apparatus for packaging articles.

It is known to package articles by wrapping them in flexible sheet material such as, for example, highly stretched synthetic plastics film. An article, or a group of articles, is typically enclosed between two sheets of material or a folded single sheet and the material is heat sealed at overlapping edges.

A continuous process for wrapping articles in material of this kind is described in international patent application WO 90109316 which discloses a longitudinal wrapping machine whereby articles are wrapped by winding a continuous web of wrapping material around the articles in a direction generally transverse to their direction of movement along the machine. This results in the articles being wrapped by a helical continuous web of material. The machine has an upstream conveyor that is separated from a downstream conveyor by a rotary ring-type web applicator whose rotary axis is generally parallel to the longitudinal axis of the conveyors. The articles are fed to the applicator by the upstream conveyor and as they pass through the ring of the applicator at a predetermined speed it rotates and dispenses the wrapping material. As a result, the articles are wrapped by a continuous helical band of material. The wrapped articles pass to the downstream conveyor which carries them to a cutting station. A longitudinal web of material disposed on the conveyors passes through the applicator and is transported under the articles at the same rate. This web serves to bridge the gap between the upstream and downstream conveyors and thus supports the articles as they pass continuously between them.

The machine referred to above has been used successfully in commercial applications but is relatively complex. There is a desire to simplify the machine and to improve its versatility.

SUMMARY OF THE INVENTION

According to a first aspect of the present invention there is provided packaging apparatus for helically wrapping articles comprising a wrapping material applicator, a first conveyor for transporting unwrapped articles towards said applicator and a second conveyor for transporting articles that have been helically wrapped with flexible sheet material by the applicator, the first and second conveyors being spaced apart, the wrapping material applicator being disposed between said first and second conveyors and which serves, in use, to pass the wrapping material between the spaced apart first and second conveyors so as to wind it around and wrap an article disposed in the space between the conveyors, the applicator comprising a rotary member and a fixed guide member, the rotary member being rotatable relative to and supported in rotation by the guide member, at least one reel shaft for supporting a reel of wrapping material mounted on the rotary member, a plurality of rotary tensioning rollers supported on the rotary member and for applying tension to the wrapping material, a drive member for driving the rotary member in rotation relative to the guide member, and a transmission device between the rotary member and the guide member for converting the relative movement of the rotary member and guide member into rotation of the tensioning rollers.

The invention provides for compact packaging apparatus with reduced components compared to conventional designs.

It allows tension to be applied to the wrapping material (re-stretch) prior to it being wrapped around the article and without the need for separate drives with speed controllers. The wrapping material provides not only a protective cover against e.g, dust or the like but also gives structural support to the articles.

The drive member preferably engages with a surface of the rotary member so as to drive it in rotation. The rotary member may be in the form of an annulus with an inner surface for driving engagement with the drive member. The inner surface is preferably a toothed surface for engagement with a tooth wheel of the drive member.

The guide member ideally comprises an annular guide surface on which the rotary member is supported in rotation. The guide surface is a cam surface that is engaged with at least one cam follower mounted on the rotary member. The cam surface may be an annular rib that engages with corresponding recesses in the cam follower. The cam follower may be in the form of a roller with a recess therein.

The guide member ideally has a surface that is drivingly connected to the transmission member so as to enable driving of the tension rollers in rotation at different rotary speeds so as to apply a stretch or tension to the wrapping material.

The transmission device is preferably in the form of a gear train that preferably includes gear wheels attached to the tensioning rollers. The surface of the guide member is preferably an annular, toothed surface that meshes with toothed gear wheels of the tension rollers. There may be an idler gear between the gear wheel of the rollers. Ideally there are provided a plurality of apertures in the rotary ring that offer alternative locations for the idler gear. Preferably there is a first gear wheel connected to a first tensioning roller and a second gear wheel connected to a second tensioning roller, the first gear wheel being in engagement with the annular toothed surface of the guide member and the idler gear wheel being disposed between the first and second gear wheels. The first and second gear wheels are preferably of different sizes to allow for differential angular velocities so as to apply tension to the wrapping material in use.

The annular, toothed surface is preferably adjacent to the cam surface.

An idler roller may be provided adjacent to the reel shaft and in use the wrapping material is passed over the idler roller. The idler roller is ideally connected to the reel shaft by an endless loop belt so as to maintain them at the same angular velocity.

Preferably there is a plurality of reel shafts spaced around the rotary member.

There may be further provided a reel of wrapping material for laying a band of wrapping material under the articles to be wrapped.

According to a second aspect of the present invention there is provided packaging apparatus for helically wrapping articles comprising a wrapping material applicator, a first conveyor for transporting unwrapped articles towards said applicator and a second conveyor for transporting articles that have been helically wrapped with flexible sheet material by the applicator, the first and second conveyors being spaced apart, the wrapping material applicator being disposed between said first and second conveyors and which serves, in use, to pass the wrapping material between the spaced apart first and second conveyors so as to wrap an article disposed in the space between the conveyors, at least one reel shaft for supporting a reel of wrapping material mounted on the rotary member, and at least one idler roller adjacent to the reel shaft for guiding the wrapping material as it is unwound from the reel, wherein there is provided endless loop elongate flexible transmission element around reel shaft and idler roller that ensure that the roller and shaft rotate at substantially the same angular velocity.

This aspect of the invention ensures that a constant tension is applied to the reel of wrapping material as it is unwound from the reel regardless of the amount of material on the reel.

According to a third aspect of the present invention there is provided a method for packaging articles using a wrapping material applicator that is disposed between first and second conveyors, comprising the steps of conveying articles to be wrapped towards the applicator, the applicator having a rotary member that supports at least one reel of wrapping material and a plurality of tensioning rollers, rotating the rotary member of the applicator and supporting the rotation on a guide member, the wrapping material being wrapped around the articles and drawn from the reel by the articles as the rotary member rotates, using the relative rotation of the rotary member and the guide member to drive rotation of tensioning rollers so as to apply a stretch to the wrapping material before it contacts the articles.

The articles are wrapped continuously as they are moved by the conveyors in a direction substantially parallel to a rotary axis of the applicator.

BRIEF DESCRIPTION OF THE DRAWINGS

Specific embodiments of the present invention will now be described, by way of example only, with reference to the accompanying drawings in which.

DETAILED DESCRIPTION OF THE INVENTION

Figure 1:
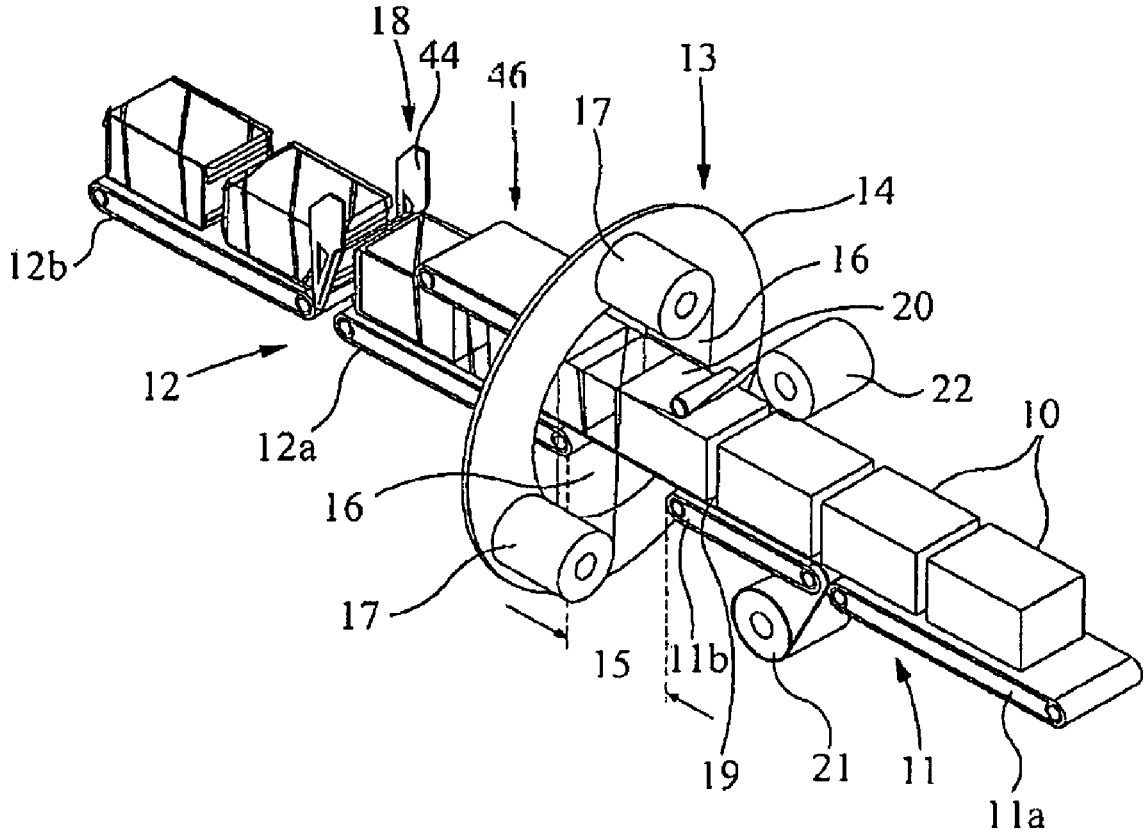
FIG. 1 is a perspective view of the apparatus of the present invention.

Referring now to FIG. 1, articles 10 to be wrapped are transported from an upstream conveyor 11 to a downstream conveyor 12 via a wrapping material applicator 13 that incorporates a rotary ring 14. The upstream and downstream conveyors 11, 12 are spaced apart and the applicator 13 is disposed in the gap 15 between them. The applicator ring 14 rotates continuously about an axis that is substantially parallel to the longitudinal axes of the conveyors 11, 12 and dispenses wrapping material 16 from three reels 17 (one hidden in FIG. 1) disposed at angular intervals around a front face of the ring. The wrapping material on each reel 17 is in the form of a continuous elongate web of thin, stretchable synthetic plastics film such as a polyurethane based material. As the articles 10 pass through the ring 14 the film 16 is stretched and then wrapped in a helical fashion around them and any supporting material. The wrapping process continues as the articles progress along the conveyor such that the material is still wound in a helical fashion around the spaces between the articles so as to produce a continuous wrap of articles. The film is designed to recover from the stretching so that it shrinks tightly around the articles after wrapping.

The upstream and downstream conveyors 11, 12 are both arranged in two adjacent sections and a cutting station 18 is interposed between adjacent sections 12*a*, 12*b* of the downstream conveyor 12. Here the individual articles are separated by cutting through the wrapping material in the space between adjacent articles 10.

Further bands of wrapping material 19, 20 are drawn from a pair of reels 21, 22 disposed above and below the upstream conveyor 11. A lower one of the further bands 19 is unwound from a reel 21 under the upstream conveyor 11, emerges between the adjacent sections 11*a*, 11*b* of the upstream conveyor and is transported under articles 10 across the gap 15 to the downstream conveyor 12. This lower band 19 serves to facilitate the transfer of each article 10 across the gap 15 from the upstream to the downstream conveyors by providing a continuously running surface that moves with the conveyors. An upper band 20 is dispensed from a reel 22 disposed above the upstream conveyor 11 so as to overlie a top surface of the articles 10. Both the upper and lower bands 20, 19 may move in adhesion with the articles 10 and may be of the same or similar material to that of the main wrapping material film 16. It will be appreciated that as the articles 10 are wrapped by the applicator 13, the helical bands 16 also wrap around the upper and lower bands 20, 19 and in the process turn up or down around the article any exposed side edges of the bands. The completed wrapped article will thus have external helical wraps containing both the article 10 and the sheets of the upper and lower bands 20, 19 of wrapping material.

In operation the articles 10, the upper and lower bands 20, 19 of wrapping material and the conveyors 11, 12 all translate at effectively the same linear speed even if the downstream conveyor 12 is driven at a slightly faster speed than the upstream conveyor 11 as can be advantageous.

As the articles 10 are sitting on the lower band 19 of wrapping material there is no external force to disturb the spacing between adjacent articles. The weight of the articles 10 on the band 19 can serve as the sole agency for drawing the material through the machine as at least the downstream conveyor 12 is driven and the consequent tension in the band 19 between the conveyors 11, 12 can be enough to convey the articles successfully across the gap 15. In practice, a bracket or other form of support surface may be used to span the gap 15 and support the band 19 as it passes across the gap 15 as described in PCT/GB90/00266.

An upper conveyor 46 on the downstream side provides support for the packaged articles as they exit the wrapping applicator. It serves to prevent the packs from being twisted over on account of the forces applied by the applicator and serves to pull the wrapped articles through the apparatus.

Turning now to FIGS. 2 to 6, the rotary ring 14 of the applicator 13 is supported in rotation by engagement with an adjacent fixed guide ring 23 that is on the downstream side. The rotary ring 14 has a plurality of rotary cam followers in the form of rollers 24 mounted on shafts 25 that are arranged at spaced angular intervals and extend from a rear face of the ring. The rollers 24 each have a grooved periphery 26 that rides on a complementary annular cam surface 27 on the periphery of the guide ring 23 which surface 27 takes the form of an inverted V-shape in section. The rotary ring 14 has an inner, toothed annular surface 28 and is driven in rotation by a pinion 29 that meshes with the toothed surface 28 and is mounted on the output shaft 30 of a servo controlled drive motor 31. As the rotary ring 14 rotates the cam follower rollers 24 ride and rotate over the peripheral cam surface 27 of the guide ring 23 in a smooth action.

Figure 5:
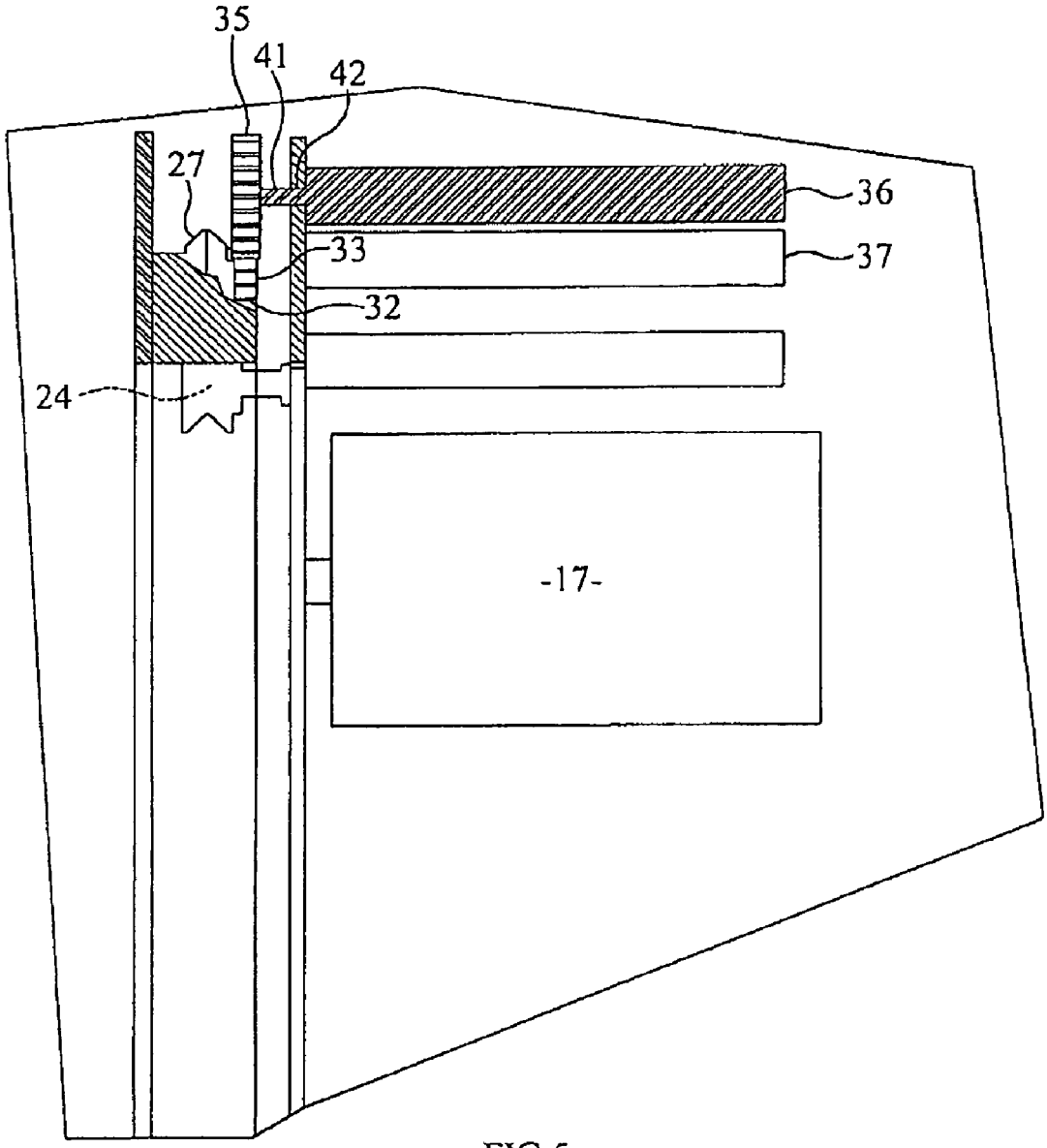
FIG. 5 is an enlarged side view of part of the applicator ring of FIG. 3 illustrating the wrapping material pre-stretch tensioning rollers.
Figure 6:
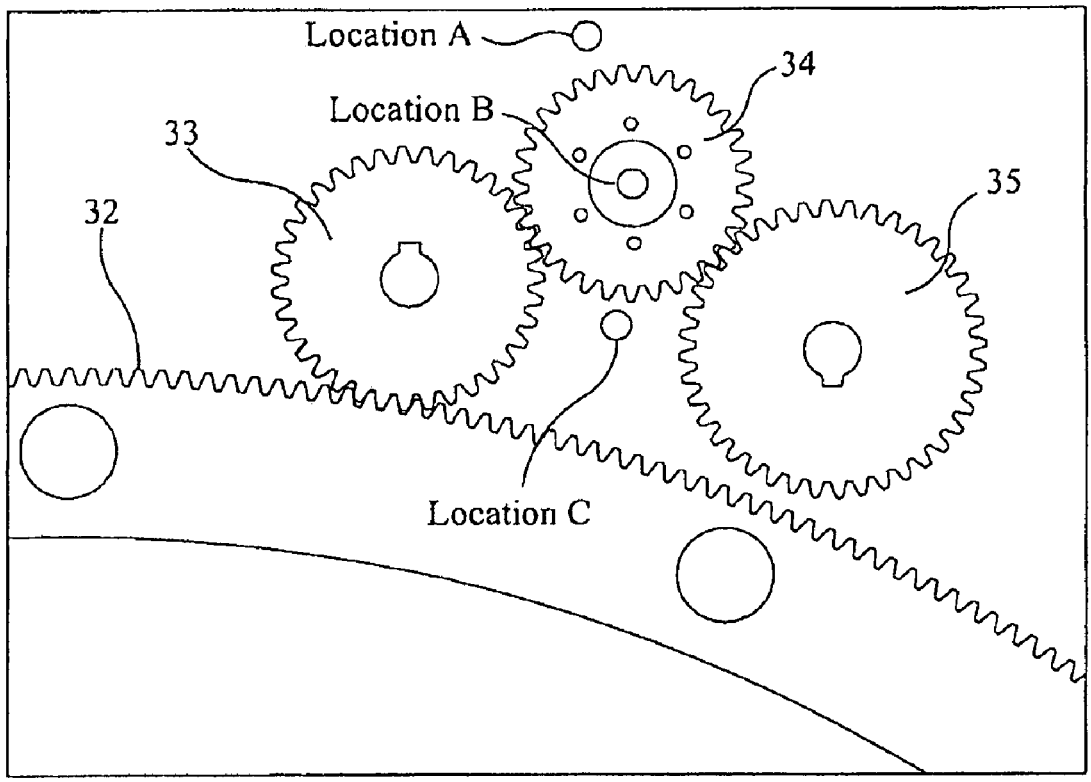
FIG. 6 is a rear view of part of the applicator of FIG. 5, showing the drive for the tensioning rollers.

In addition to the cam surface 27, the guide ring 23 also defines an annular toothed surface 32 on its outer periphery. This toothed surface 32, seen most clearly in FIG. 5, is immediately adjacent to the cam surface 27 and meshes with gears 33,34, 35 that drive tensioning rollers 36 and 37 for applying a pre-stretch to the wrapping material 16 as it is unwound from the reels 17, as will described in more detail below.

The reels 17 of the helical wrapping material 16 are each mounted on a shaft 38 that is rotatably supported on a respective bracket 39 extending radially from, and fixed to, the periphery of the rotary ring 14. The shafts 38 are arranged at equi-angular intervals around the front face of the ring 14 and each extends in a direction parallel to the rotary axis of the ring 14. The wrapping material 16 that is unwound from each reel 17 passes around a series of three rollers positioned in close proximity to the shaft 38 and extending in parallel thereto. One of such rollers operates as an idler roller 40 that guides the direction of the unwound material and is rotatably mounted on the bracket 39 at a location spaced from the shaft 38 whilst the other two rollers are the tensioning rollers 36, 37 referred to above and that are rotatably supported on the front face of the rotary ring 14 with a small spacing therebetween, radially inwardly of the guide roller 40. A first of the tensioning rollers is a feed roller 36 and the other is an applicator roller 37. Both rollers 36, 37 are covered with a suitable friction coating or texturing that may be applied by laser deposition or other coating techniques, etching or knurling or the like to provide asperities on the roller surface that serve to grip the wrapping material as it passes over the rollers.

Each of the tensioning rollers 36,37 has a reduced diameter at one end so as to define a drive shaft 41 that passes through an aperture 42 in the rotary ring 14. On the rear face of the rotary ring, corresponding gear wheels 33, 35 are mounted on each of the shafts 41 in a fixed relationship. The gear wheel 33 associated with the applicator roller 37 is disposed in a fixed radial location such that its teeth mesh with those defined on the toothed periphery 32 of the guide ring 23. The gear wheel 35 associated with the feed roller 36 is circumferentially spaced from the applicator gear 33 and is disposed at a fixed radial location such that its teeth are clear of those 32 defined on the outer periphery of the guide ring 23. Interposed between the applicator and feed gears 33, 35, in a meshing relationship, is an idler gear 34 that is mounted to the rear of the rotary ring 14 but which can be selectively disposed at one of three radial locations provided by three apertures in the ring (these are labelled as location A, B and C in FIG. 6). The tension (and therefore the pre-stretch) applied to the wrapping material 16 can be varied by changing the size of the applicator and feed gear wheels 33, 35 (which are removable) and moving the position of the idler gear 34 between locations A, B and C.

Figure 2:
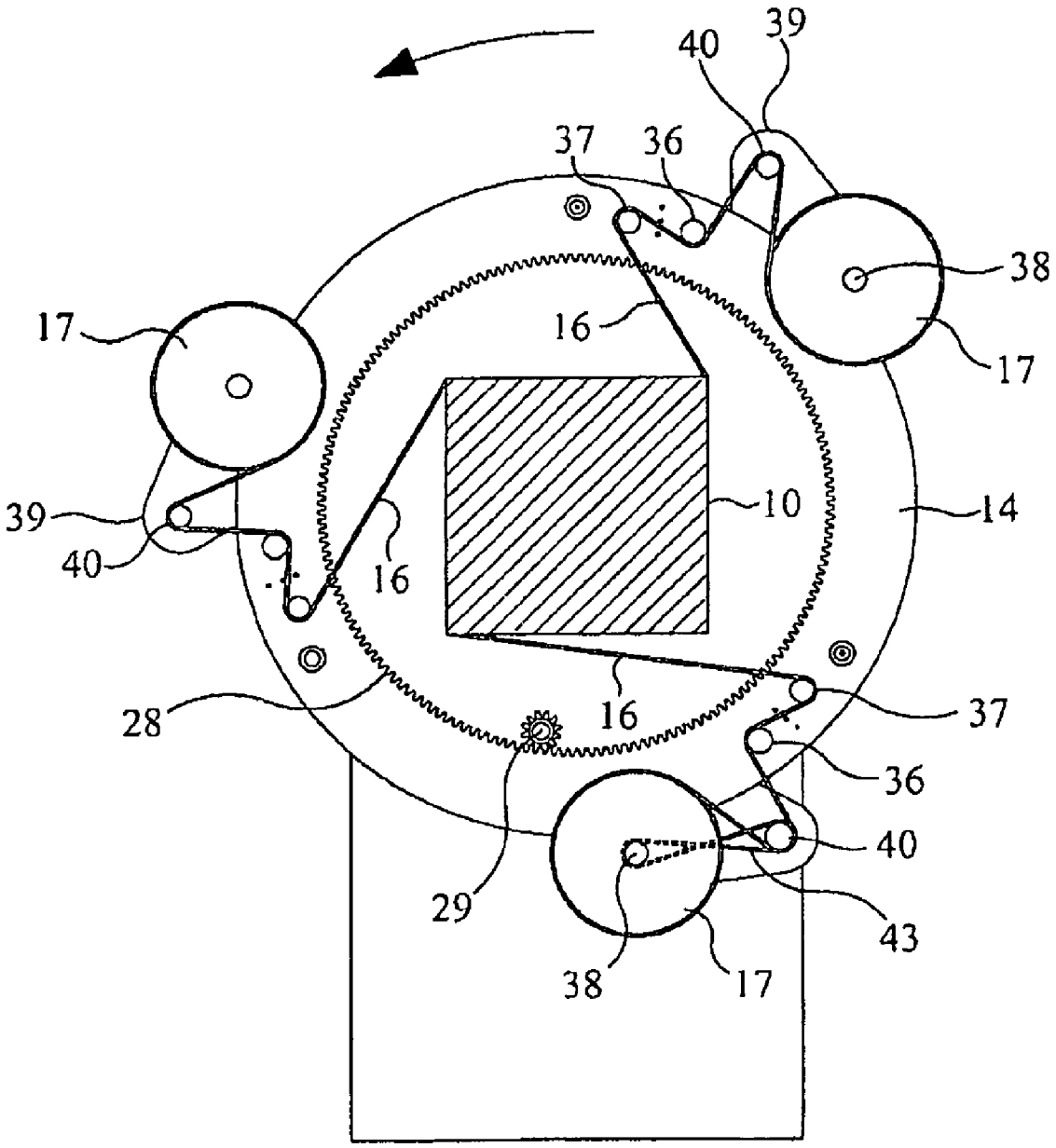
FIG. 2 is a front view of the packaging material applicator ring of the present invention, shown with an article being wrapped.
Figure 3:
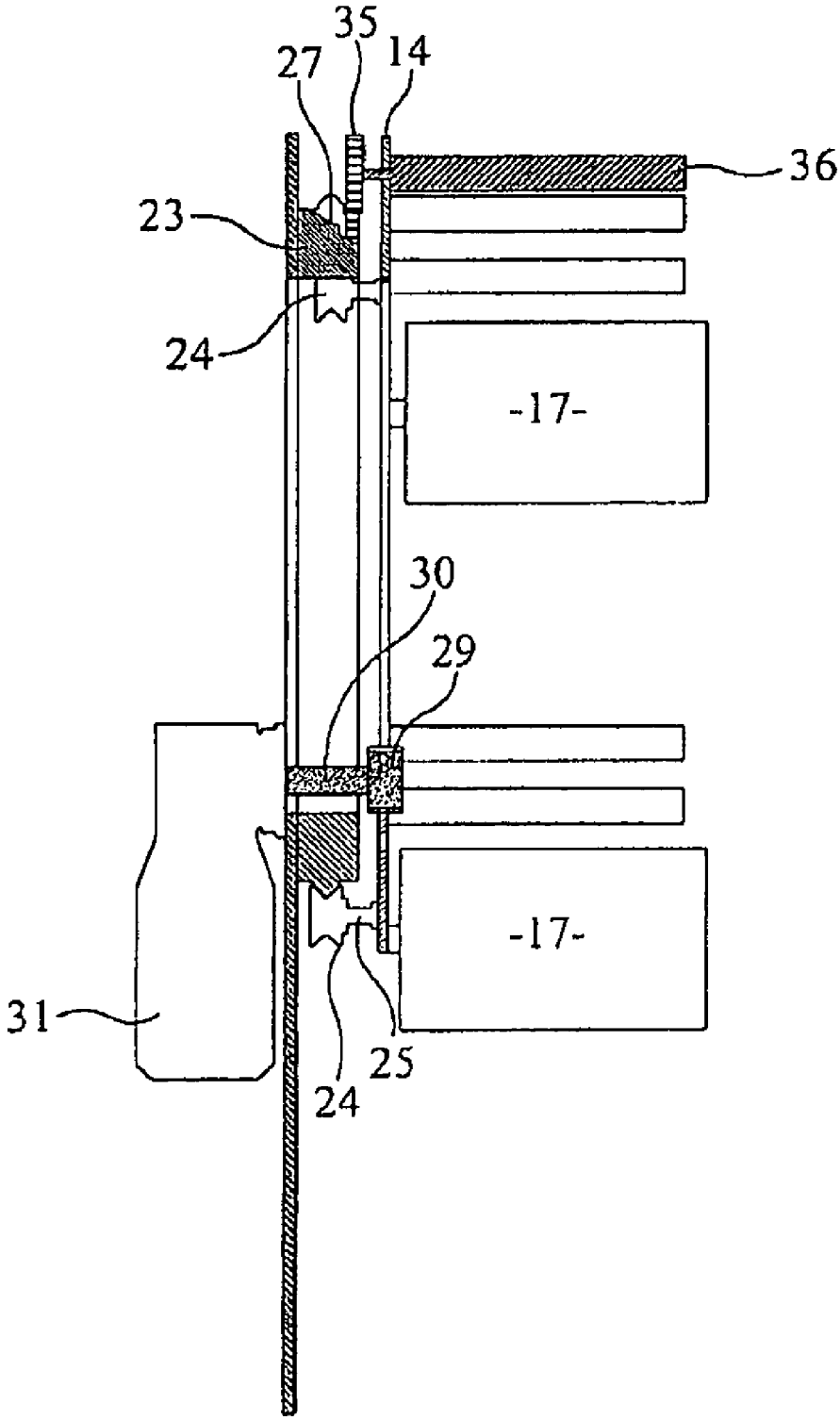
FIG. 3 is a side sectioned view of the applicator ring of FIG. 2.
Figure 4:
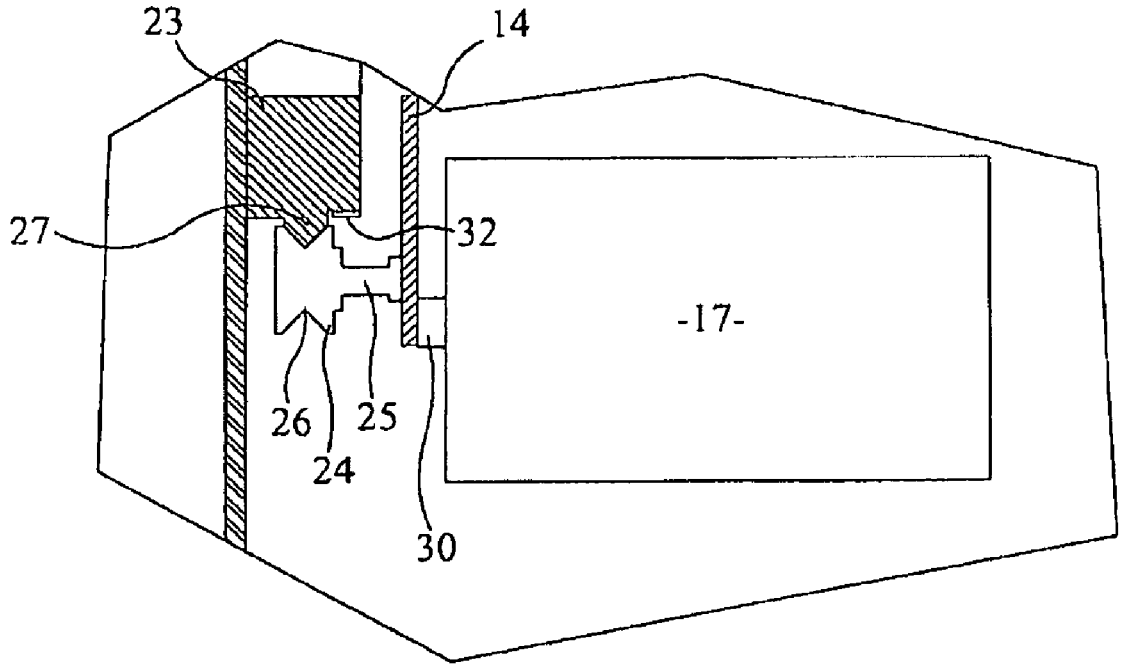
FIG. 4 is an enlarged view of part of FIG. 3 illustrating the support provided by a guide member for the applicator ring.

As can be best seen in FIG. 2, the wrapping material is unwound from each reel 17 by the article 10 to be wrapped as the rotary ring 14 rotates. The wrapping material 16 from each reel 17 passes over the idler roller 40, under the feed roller 36 and over the applicator roller 37 from where it is drawn by the article 10 to be wrapped. The reel shaft 38 is connected to the idler roller 40 by a twisted elastomeric belt or band 43 (only one shown in FIG. 2) so as to ensure that they rotate at the same angular velocity and a constant tension is thereby applied to the film 16 as it is unwound from the reel 17, irrespective of the amount of material left of the reel and the size of the article to be wrapped. It also serves to ensure that there is constant elastic tension in the film as it is unwound from the reel and to overcome the resistance of the reel to rotation owing to its inertia and the adherence between adjacent layers of film on the reel. As the rotary ring 14 rotates, the applicator roller 37 is driven in rotation by virtue of the engagement of the applicator gear wheel 33 with the teeth 32 on the periphery of the guide ring 23. The applicator gear 33 in turn drives the idler gear 34 which then drives the feed gear 35 in the same direction of rotation as the applicator gear. The feed gear wheel 35 has a larger diameter than the applicator gear wheel 33 so that the applicator roller 37 rotates at a faster rate than the feed roller 36 and thereby stretches the wrapping material 16 before it is presented to the articles.

As the articles 10 pass the rotary ring applicator 14 the wrapping film material 16 is helically wound around them and the upper and lower bands 20, 19. The wrapped train of articles then passes the cutter station 18 where the helical wrapping film 16 is severed to leave individual packs of wrapped articles. The cutter station 18 comprises a frame 44 on which there is supported a heated horizontal wire that is moved in a vertical direction to heat and sever the wrapping material 16. The wrapping film naturally shrinks around the articles to provide for a self-contained wrapped package.

Figure 7:
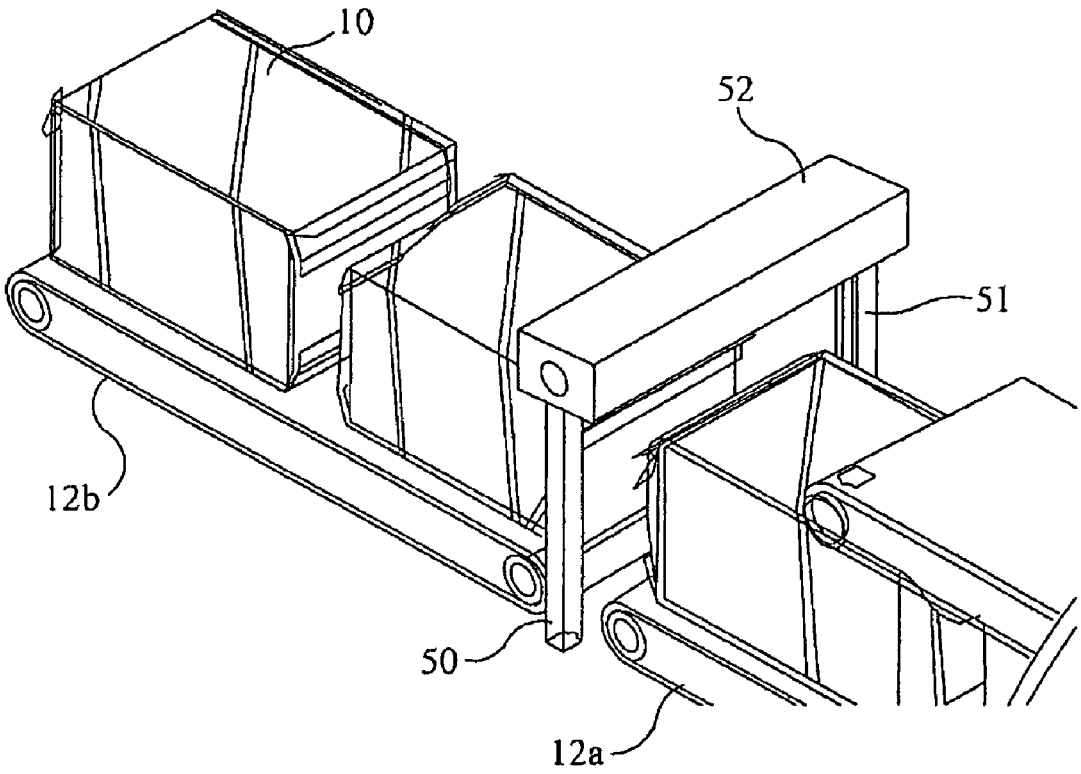
FIG. 7 is perspective showing part of the packaging apparatus of the present invention with an alternative embodiment of the cutting station.
Figure 8A:
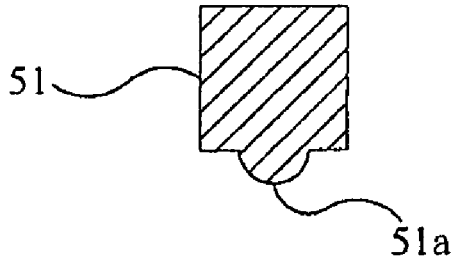
FIGS. 8(*a*) and (*b*) are schematic sectioned views of cutter members of the cutting station of FIG. 7 shown in spaced and cutting positions.
Figure 8A:
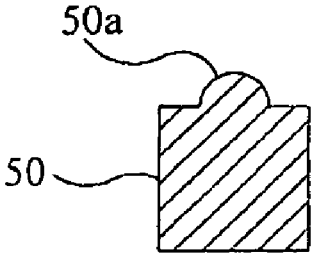
Figure 8B:
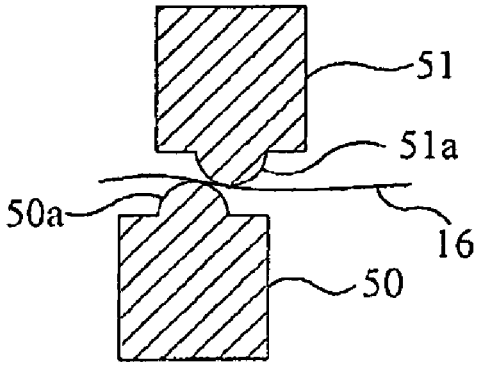

An alternative cutting station configuration is shown in FIG. 7 in which two heated cutting beams 50, 51 are suspended from a horizontal support member 52 to extend in a vertical direction at the space between the downstream conveyors. The beams are made from a suitable metallic or ceramic material and contain an electric heating element such as a wire. The supported member contains a linear actuator, such as a hydraulic or pneumatic ram, to opposite ends of which the beams are fixed. One of the beams is movable relative to the other by actuation of the ram. The movement takes the beams from a spaced position where they are clear of the articles on each side of the conveyors and a cutting position where they are brought together. In the latter position the heated cutting beams are brought together to effect severance by heating of the wrapping film sandwiched between them. The form of the cutting beams 50, 51, which can be seen from FIGS. 8*a* and 8*b* is designed to provide a narrow cutting area, each comprises a raised arcuate cutting profile 50*a*, 51*a*. One of the beams 51 is moved towards the other 50 from the rest position shown in FIG. 8(*a*) to that shown in FIG. 8(*b*) where the arcuate surfaces 50*a*, 51*a* come into contact to heat and sever the film 16 between them. For the type of film that is contemplated the arcuate surface of the beam is generally heated to around typically 120° C. in order to achieve effective severance.

Figure 9A:
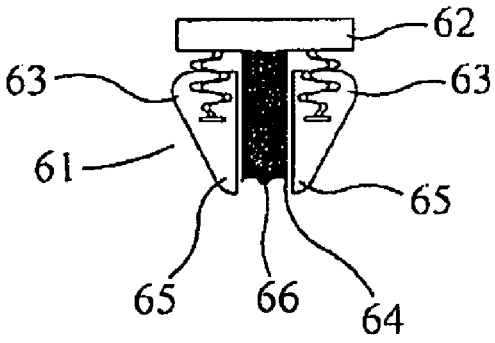
FIGS. 9(*a*) and (*b*) are schematic sectioned views of an alternative embodiment of the cutters for the cutting station shown in spaced apart and cutting positions.
Figure 9A:
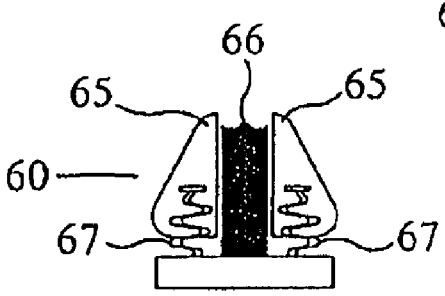
Figure 9B:
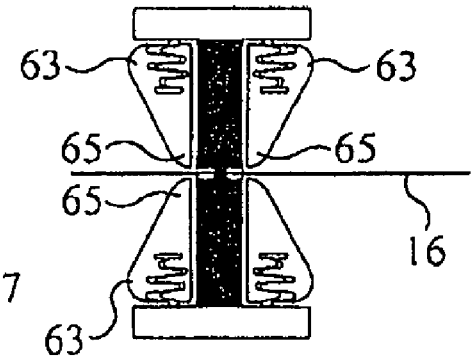

In an alternative cutter embodiment shown in FIGS. 9*a* and 9*b*, the beams 60, 61 each comprise a base 62 that supports a pair of retractable outer sealing members 63 that flank an inner cutting member 64. The outer retractable sealing members 63 taper inwardly in a direction away from the base 62 and terminate in sealing tip portions 65 whereas each inner cutting member 64 is generally rectangular with a protruding cutting tip 66 at its exposed end. The outer sealing members 63 are spring mounted to the base 62 so that they are biased to a first position here their sealing tips 65 extend beyond the cutting tip 66 of the inner cutting member 64 (see FIG. 9(*a*)). Both the sealing members 63 and the cutting member 64 are heated as before, the inner cutting member being heated, in use, to a first temperature designed to cut through the film and the sealing members are heated to a lower temperature that is only sufficient to fuse the film together. When the beams 60, 61 are brought together to sever the wrapping film 16, the tips 65 of the opposed sealing members 63 of the beams 60, 61 first contact the wrapping film 16 together to effect sealing. Thereafter further movement of the beams 60, 61 brings the sealing members 63 into engagement and causes them to retract on the base and compress the springs 67. When the sealing members are retracted the cutting member 64 of each beam is exposed and its tip 66 comes into contact with the film 16 so as to effect severance.

Figure 10:
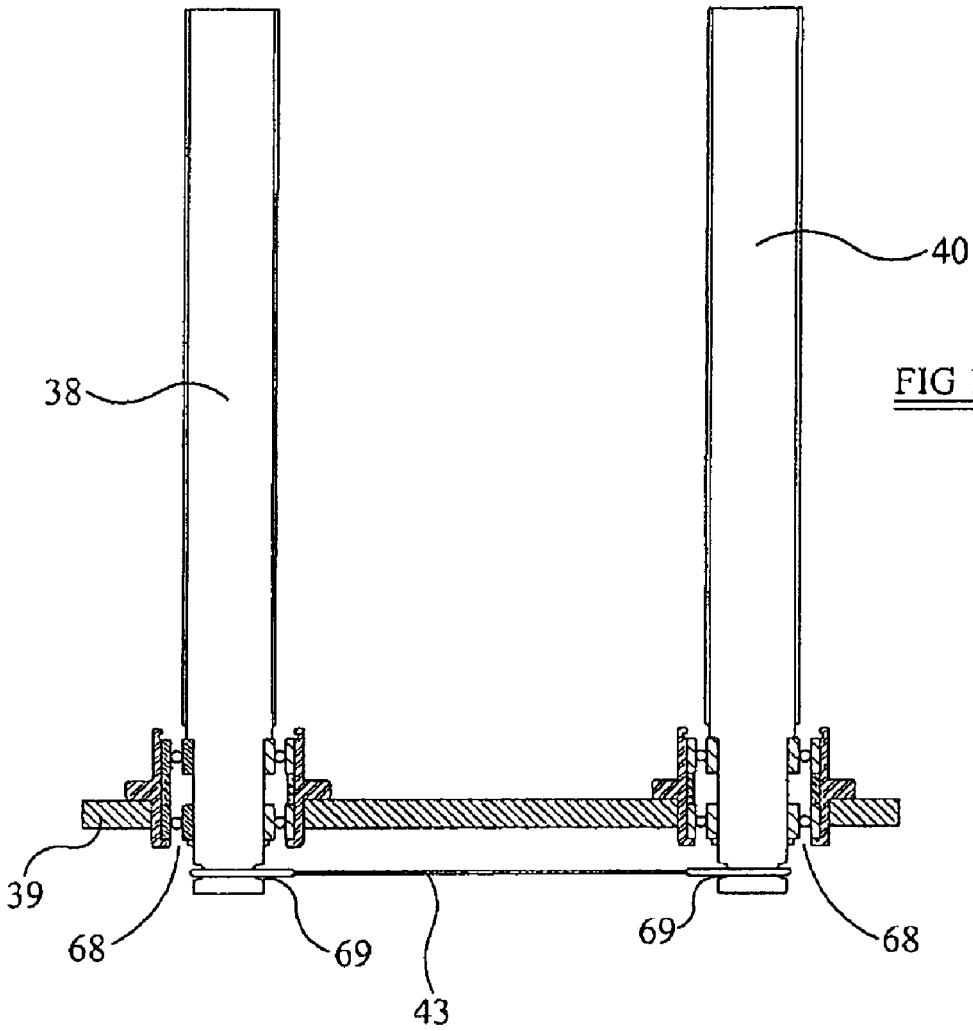
FIG. 10 is a sectioned view of a reel shaft and idler roller forming part of the present invention.
Figure 11:
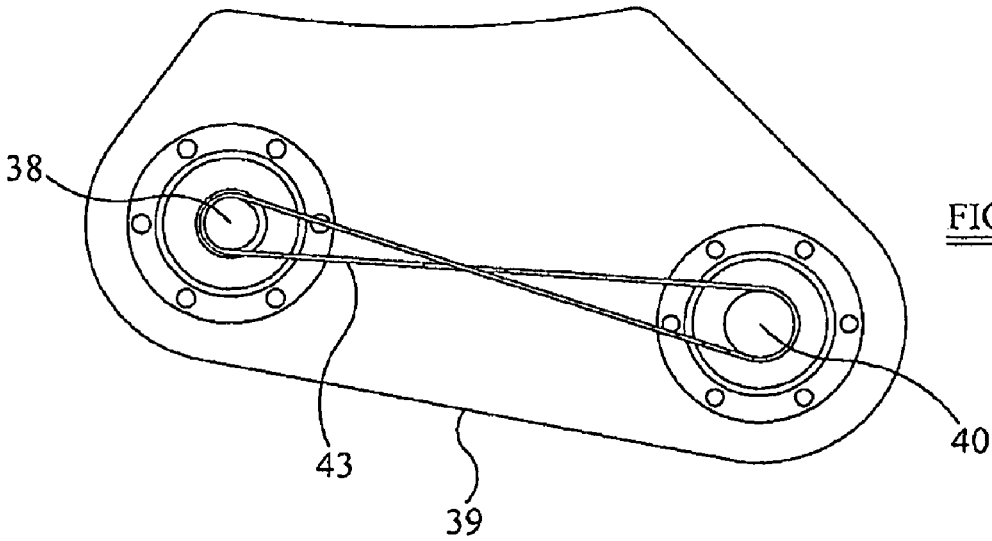
FIG. 11 is a rear view of the shaft and roller of FIG. 10.
Figure 12:
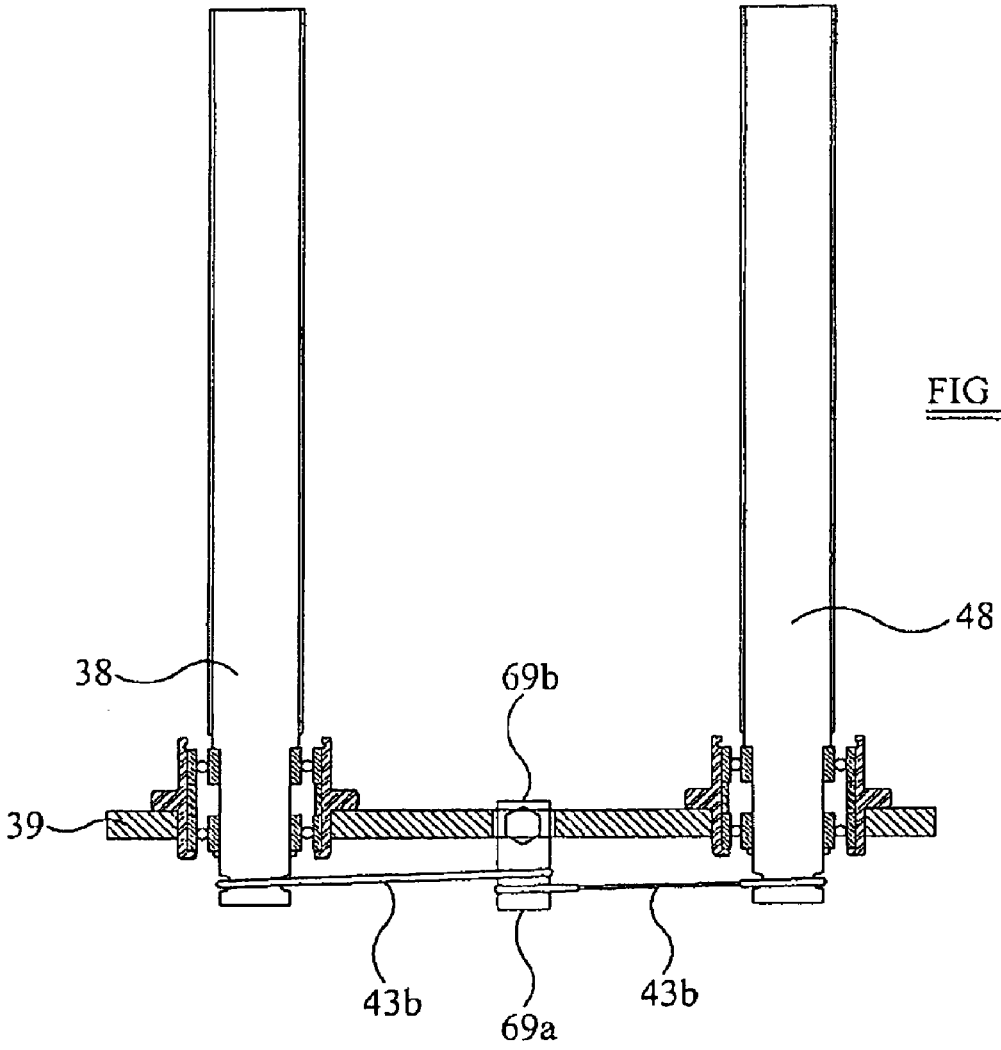
FIG. 12 is a sectioned view of an alternative embodiment of the reel shaft and idler roller shown with a tensioning feature.
Figure 13:
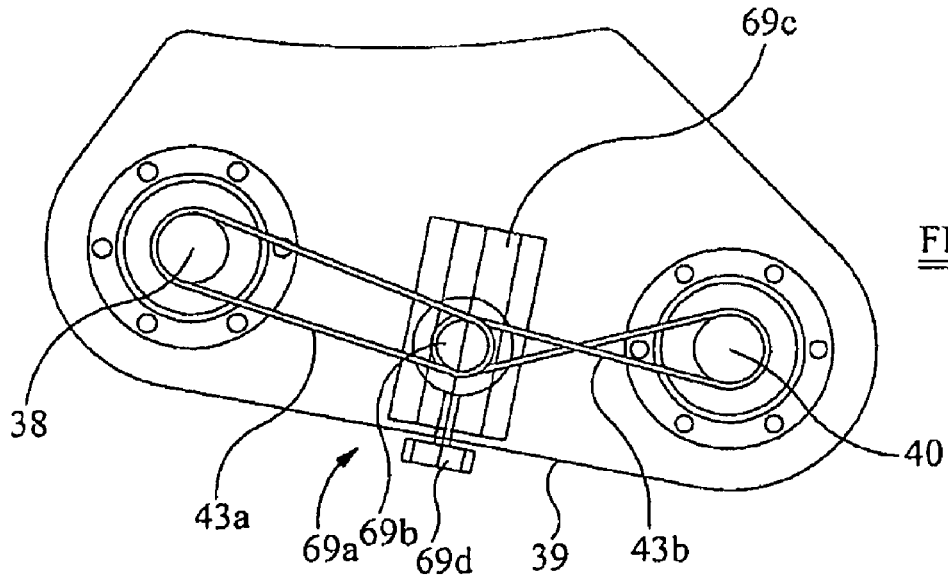
FIG. 13 is a rear view of FIG. 12.

FIGS. 10 and 11 show in detail the arrangement of the twisted elastomeric belt or band 43 that extends around the idler roller 40 and the reel shaft 38. The shaft and roller are mounted in journal bearings 68 in the bracket 39 and the band 43 such that one end projects from the rear face thereof. The band 43 is disposed in annular grooves 69 in the shaft and rollers at the rear ends In an alternative embodiment shown in FIGS. 12 and 13 there are provided two such bands 43*a* and 43*b*. A first band 43*a* is connected between the reel shaft 38 and the tensioning device 69 and the second band 43*b* is connected between the tensioning device 69*a* and the idler roller 40. The tensioning device 69*a* comprises a rotary stub shaft 69*b* that is moveable laterally of its axis of rotation along a guide track 69*c* by an adjustment knob 69*d* to vary the tension in the band.

Figure 14:
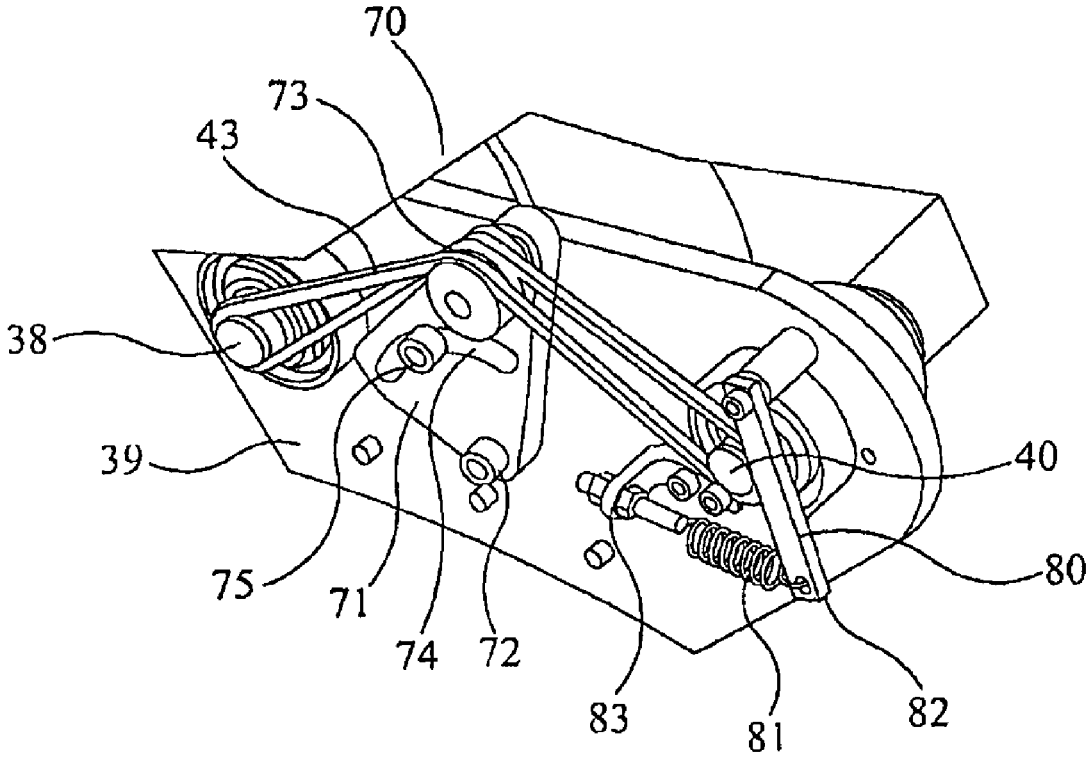
FIG. 14 is a perspective fragment view of a further alternative embodiment of the reel shaft and idler roller band tensioning device.

A further alternative arrangement of the connection between each of the reel shafts 38 and idler rollers 40 is illustrated in FIG. 14. In this embodiment the tensioning device 70 is in the form of a pivoting arm 71 that comprises a triangular plate pivotally mounted on the support bracket 39 at a first apex by a pin 72. A tensioning roller 73 disposed at an opposite apex is designed to engage and tension the belt 43 extending between the reel shaft 38 and the idler roller 40. The arm 71 has an arcuate slot 74 that receives a fixed guide pin 75 projecting from the bracket 39 such that the slot 74 can move over the pin 75 during pivoting movement of the arm 71. The length of the slot 74 thus limits the range of angular movement of the arm 71. The idler roller 40 is fitted with a braking system comprising a pivotal brake arm 80 mounted adjacent to the idler roller 40 and biased into contact with the circumferential surface of the roller 40 by a tensioning coil spring 81 connected between the end 82 of the brake arm 80 that is opposite the pivot and a fixed lug 83 mounted on the bracket 39 on the opposite side of the roller 40. The brake arm 80 is configured to apply a braking force to the idler roller 40 and for this purpose either comprises a slip resistant friction material or is coated, plated or otherwise covered, at least in part, with such a material. The brake arm 80 acts against the belt 43 and the idler roller 40 and thereby serves to brake the rotation of the idler roller 40 and therefore the film reel shaft 38. By operating against both the belt 43 and the roller 40 the brake arm 80 not only retards the film reel as it unwinds but also increases the tension with which the film is pulled from the reel 17. The connection between the coil spring 81 and the lug 83 is adjustable so that the braking force can be varied. This feature allows an operator to balance the tension in the wrapping material films 16 as they are unwound from each reel 17. In order to do this the operator will typically arrange for the films 16 to be unwound by a spring load balance device (not shown) and attach an appropriate tension measurement gauge across the width of the film. The tension in each of the films is then tuned by adjusting each of the coil spring tensions 81 applied to the brake arms 80. This arrangement also helps reduce chatter in the unwinding process.

It is to be understood that the belt tensioning arrangement described above and illustrated in FIG. 14 could be used instead of those described previously and without the braking system if desired.

The wrapping film is typically in the region of 7 to 9 microns thick.

The invention has many advantages compared to existing designs. In particular, the provision of the guide ring advantageously supports the rotation of the rotary ring and also enables the movement of the rotary ring to be used in driving the tensioning rollers. By using a gear train as the transmission between the guide ring and the rotary ring the requirement for differential drive speed or tensioning arrangements for those rollers can be eliminated.

The invention provides for a packaging method that ensures that there is no significant waste wrapping material.

It has been established in tests that for a pack of 350 mm by 350 mm in section, 3 reels, 40 rpm rotary ring speed, 20% overlap in wrap and conveyor running at 12 m, per minute can achieve around 35 ppm The apparatus obviates the need for a separate heat shrink oven that would be unsuitable for certain types of heat sensitive articles (e.g. aerosols)

The apparatus has a relatively small size compared to existing designs.

It is to be appreciated that lower film band 19 is not essential if a low friction plate or bracket is used to bridge the gap 15 and the friction characteristics of the conveyor belts are high enough to enable the articles to be transported across the gap between upstream and downstream conveyors.

Moreover, it is to be appreciated that the upper film band 20 is not essential and is generally only to be used where the article have sharp edges or other protrusions that have a tendency to pierce the helical wrapping film.

The present invention has the advantage that there is no need to alter the machine set-up for different size and shapes of articles. Generally prior art machines use a different width film for different width products.

The provision of a belt or any other flexible endless loop transmission element between the reel shaft and the idler roller allows for a constant tension to be applied to the film as it unwinds form the reel regardless of the amount of material left on the reel.

The apparatus is designed to use thin pre-stretched film with folded edges to give strapping resistance to the pack. The helical wrapping film obviates the need for other packing elements such as boxes, trays etc.

On all the conveyors the texture of the belts is designed to optimise the friction between the articles and the belt surface.

It is to be appreciated that the wrapping apparatus may have applications outside of packaging of articles with synthetic plastics film. For example, the same invention could be used to wrap any elongate flexible material such as a textile, fibres, strips of material, metal composite bands or the like to an article to create any sort of structural component.

We claim:

1. Packaging apparatus for helically wrapping articles comprising a wrapping material applicator, a first conveyor for transporting unwrapped articles towards said applicator and a second conveyor for transporting articles that have been helically wrapped with flexible sheet material by the applicator, the first and second conveyors being spaced apart, the wrapping material applicator being disposed between said first and second conveyors and which serves, in use, to pass the wrapping material between the spaced apart first and second conveyors so as to wind the wrapping material around and wrap an article disposed in the space between the conveyors, the applicator comprising a rotary member and a fixed guide member, the rotary member being rotatable relative to and supported in rotation by the guide member, at least one reel shaft for supporting a reel of wrapping material mounted on the rotary member, an idler roller adjacent to the reel shaft for guiding the wrapping material as it is unwound from the reel, a plurality of rotary tension rollers supported on the rotary member and for applying tension to the wrapping material, a drive member for driving the rotary member in rotation relative to the guide member, and a transmission device between the rotary member and the guide member for converting the relative movement of the rotary member and guide member into rotation of the tension rollers, wherein the guide member has a surface that is drivingly connected to the transmission device so as to enable driving of the tensioning rollers in rotation at different rotary speeds so as to apply a stretch or tension to the wrapping material and wherein the idler roller is connected to the reel shaft by an endless loop belt.

2. Packaging apparatus according to claim 1, wherein the drive member engages with a surface of the rotary member so as to drive the rotary member in rotation.

3. Packaging apparatus according to claim 1, wherein the rotary member is in the form of an annulus with an inner surface for driving engagement with the drive member.

4. Packaging apparatus according to claim 3, wherein the inner surface is a toothed surface for engagement with a toothed wheel of the drive member.

5. Packaging apparatus according to claim 1, wherein the guide member comprises an annular guide surface on which the rotary member is supported in rotation.

6. Packaging apparatus according to claim 5, wherein the annular guide surface is a cam surface that is engaged with at least one cam follower mounted on the rotary member.

7. Packaging apparatus according to claim 6, wherein the cam surface is an annular rib that engages with corresponding recesses in the cam follower.

8. Packaging apparatus according to claim 6, wherein the cam follower is in the form of a roller with a recess therein.

9. Packaging apparatus according to claim 1, wherein the transmission device is in the form of a gear train that includes gear wheels attached to the tensioning rollers.

10. Packaging apparatus according to claim 9, wherein the surface of the guide member is an annular, toothed surface that meshes with teeth defined on the gear wheels of the tensioning rollers.

11. Packaging apparatus according to claim 10, wherein there is an idler gear between the gear wheels of the rollers.

12. Packaging apparatus according to claim 11, further comprising a plurality of apertures in the rotary ring that offer alternative locations for the idler gear.

13. Packaging apparatus according to claim 10, wherein there is provided a first gear wheel and a first tensioning roller, the first gear wheel being connected to the first tensioning roller and there is provided a second gear wheel and a second tensioning roller, the second gear wheel being connected to the second tensioning roller, the first gear wheel being in engagement with the annular toothed surface of the guide member.

14. Packaging apparatus according to claim 13, wherein the first and second gear wheels are of different sizes to allow for differential angular velocities so as to apply tension to the wrapping material in use.

15. Packaging apparatus according to claim 10, wherein the guide member comprises a cam surface that is engaged with at least one cam follower mounted on the rotary member and the annular toothed surface is adjacent to the cam surface of the guide member.

16. Packaging apparatus according to claim 1, wherein there is a plurality of reel shafts spaced around the rotary member.

17. Packaging apparatus according to claim 1, wherein there is provided a reel of wrapping material for laying a band of wrapping material under the articles to be wrapped.

18. Packaging apparatus according to claim 1, wherein there is provided a cutting station comprising at least two heated elongate cutting members that are movable between a first position in which they are clear of the wrapped articles and a second position in which they are brought together in a space between adjacent wrapped articles so as to sever the wrapping material.

19. Packaging apparatus according to claim 18, wherein the cutting members are in the form of beams each with a raised arcuate portion defining a cutting surface.

20. Packaging apparatus according to claim 18, wherein each of the cutting members comprises at least one retractable sealing member having a sealing tip and at least one cutting element having at least one cutting tip, the sealing members being retractable from a first position in which the tip extends beyond the tip of the cutting element and a second position in which the tip of cutting element extends beyond the tip of the sealing member.

21. Packaging apparatus according to claim 20, wherein there is provided means for heating the cutting element to a first temperature and for heating the sealing member to a second temperature, said first temperature being higher than said second temperature.

22. Packaging apparatus according to claim 20, wherein the retractable sealing members are biased to the first position.

23. Packaging apparatus according to claim 22, wherein the sealing members are biased by springs mounted between the sealing members and a base member of the cutting member.

24. Packaging apparatus according to claim 1, wherein the axis of rotation of the applicator is substantially parallel to a longitudinal axis of the conveyors.

25. Packaging apparatus according to claim 1, wherein the tensioning rollers each have a surface that is treated to enhance the friction between the surface and the wrapping material.

26. Packaging apparatus according to claim 25, wherein the surface of each of the tensioning roller is roughened.

27. Packaging apparatus according to claim 25, wherein a friction coating is applied or deposited on each of the tensioning roller surface.

28. Packaging apparatus according to claim 1, wherein there is a brake for applying a braking force to the idler roller.

29. Packaging apparatus according to claim 28, wherein the brake has an adjustment mechanism for adjusting the magnitude of the braking force.

* * * * *